US008480488B2

(12) United States Patent
Hornik et al.

(10) Patent No.: US 8,480,488 B2
(45) Date of Patent: Jul. 9, 2013

(54) DYNAMIC PLAYER TRACKING CARD

(75) Inventors: Jeremy M. Hornik, Chicago, IL (US); Joel R. Jaffe, Glenview, IL (US); James E. Motyl, Chicago, IL (US); Craig J. Sylla, Round Lake, IL (US)

(73) Assignee: WMS Gaming, Inc., Waukegan, IL (US)

( * ) Notice: Subject to any disclaimer, the term of this patent is extended or adjusted under 35 U.S.C. 154(b) by 0 days.

(21) Appl. No.: 13/500,828

(22) PCT Filed: Oct. 7, 2010

(86) PCT No.: PCT/US2010/051878

§ 371 (c)(1),
(2), (4) Date: Apr. 6, 2012

(87) PCT Pub. No.: WO2011/044400

PCT Pub. Date: Apr. 14, 2011

(65) Prior Publication Data

US 2012/0196671 A1 Aug. 2, 2012

Related U.S. Application Data

(60) Provisional application No. 61/249,836, filed on Oct. 8, 2009.

(51) Int. Cl.
*A63F 9/24* (2006.01)

(52) U.S. Cl.
USPC ..... 463/31; 463/16; 463/20; 463/25; 463/29

(58) Field of Classification Search
USPC ..... 463/16, 20, 25, 29, 31
See application file for complete search history.

(56) References Cited

U.S. PATENT DOCUMENTS

| | | | |
|---|---|---|---|
| 2006/0040741 | A1 | 2/2006 | Griswold et al. |
| 2009/0069076 | A1 | 3/2009 | Silvestro |
| 2009/0111562 | A1 | 4/2009 | Chudd et al. |

FOREIGN PATENT DOCUMENTS

| | | |
|---|---|---|
| WO | WO-2011044400 | 4/2011 |

OTHER PUBLICATIONS

"PCT Application No. PCT/US10/51878 International Preliminary Report on Patentability", Sep. 27, 2011 , 18 pages.
"PCT Application No. PCT/US10/51878 International Search Report", Dec. 1, 2010 , 8 pages.

*Primary Examiner* — Omkar Deodhar
(74) *Attorney, Agent, or Firm* — DeLizio Gilliam, PLLC

(57) ABSTRACT

Electronic paper (e-paper) can be incorporated onto player tracking cards (101) to allow logos, themes, and/or other content (e.g., text, images, etc.) displayed on player tracking cards to be updated. An identifier is determined based on data read from a magnetic strip on a rewritable display card (503). The rewriteable display card comprises electronic paper (103). Account information associated with the identifier is received (505). Content to be displayed on the electronic paper is determined based, at least in part, on the account information (507). The content is written to the electronic paper (513).

14 Claims, 10 Drawing Sheets

DYNAMIC PLAYER TRACKING CARD

RELATED APPLICATIONS

This application claims the priority benefit of U.S. Provisional Application Ser. No. 61/249,836 filed Oct. 8, 2009.

LIMITED COPYRIGHT WAIVER

A portion of the disclosure of this patent document contains material which is subject to copyright protection. The copyright owner has no objection to the facsimile reproduction by anyone of the patent disclosure, as it appears in the Patent and Trademark Office patent files or records, but otherwise reserves all copyright rights whatsoever. Copyright 2010, WMS Gaming, Inc.

FIELD

Embodiments of the inventive subject matter relate generally to player loyalty cards.

BACKGROUND

Many wagering game establishments operate player loyalty programs that utilize systems that track wagering behavior and collect demographic information of players. When a player joins a player loyalty program, the casino creates a personal information profile for the player and gives the player a player tracking card. The player card typically has an ink printed casino logo and includes a magnetic strip or a loyalty club number.

SUMMARY

In some embodiments, an identifier is determined based on data read from a magnetic strip on a rewritable display card. The rewriteable display card comprises electronic paper. Account information associated with the identifier is received. Content to be displayed on the electronic paper is determined based, at least in part, on the account information. The content is written to the electronic paper.

In some embodiments, one or more machine-readable media having instructions stored therein, which, when executed by a set of one or more processors, causes the set of one or more processors to perform operations. The operations comprise determining an identifier based on data read from a magnetic strip on a rewritable display card. The rewriteable display card comprises an electronic paper. The operations also comprise receiving account information associated with the identifier, and then determining content to be displayed on the electronic paper based, at least in part, on the account information. The operations further comprise writing the content to the electronic paper.

In some embodiments, a rewritable display card comprises a double-sided at least semi-rigid support structure, a magnetic strip, and an electronic paper coupled with the double-sided at least semi-rigid support structure. The electronic paper has dimensions equal to or less than those of a first side of the double-sided at least semi-rigid support structure. The electronic paper is visible on a first side of the double-sided at least semi-rigid support structure. The magnetic strip coupled with the double-sided at least semi-rigid support structure.

In some embodiments, a card reader/writer comprises a magnetic strip reader operable to determine a player identifier based on data encoded in a magnetic strip of a player tracking card. The card reader/writer also comprises an account unit operable to retrieve account information based on the player identifier, and to determine content to be displayed on an electronic paper on the player tracking card. The card reader/writer also comprises a card display controller operable to execute instructions for writing the content to the electronic paper. The card reader/writer also comprises an electronic paper printer operable to write the content to the electronic paper in accordance with the instructions executed by the card display controller.

In some embodiments, an apparatus comprises a processor, and a network interface coupled with the processor. The apparatus also comprises means for determining content to display on a player tracking card based, at least in part, on player account information associated with the player tracking card. The apparatus also comprises means for writing the content to the player tracking card.

BRIEF DESCRIPTION OF THE FIGURES

Embodiments of the invention are illustrated in the Figures of the accompanying drawings in which.

DESCRIPTION OF THE EMBODIMENTS

In the following detailed description of example embodiments, reference is made to the accompanying drawings which form a part hereof, and which is shown by way of illustration only, specific embodiments in which the inventive subject matter may be practiced. It is to be understood that other embodiments may be utilized and structural changes me be made without departing from the scope of the present invention. The description that follows includes exemplary systems, methods, techniques, instruction sequences and computer program products that embody techniques of the present inventive subject matter. However, it is understood that the described embodiments may be practiced without these specific details. For instance, although examples refer to player tracking cards, embodiments may be implemented in other types of identification and/or access cards such as hotel room key cards. In other instances, well-known instruction instances, protocols, structures and techniques have not been shown in detail in order not to obfuscate the description.

When a wagering game establishment updates its logo, it often begins issuing player tracking cards displaying the new logo so that brand identity remains consistent. However, the wagering game establishment cannot change the display on previously issued player tracking cards. The updated player tracking cards may not be quickly distributed to existing loyalty club members, because players usually do not request new player tracking cards unless their current player tracking cards have been lost or are no longer working. Electronic paper (e-paper) can be incorporated onto player tracking cards to allow logos, themes, and/or other content (e.g., text, images, etc.) displayed on player tracking cards to be updated. Examples of content include promotional information, a loyalty club account balance, reservation information, elite status indications, etc. When a player tracking card is inserted into a card reader/writer on a wagering game machine (WGM), a card display controller can determine new content to be displayed on the player tracking card. The card display controller can utilize an e-paper printer in the card reader/writer to write the new content to the e-paper.

Figure 1:
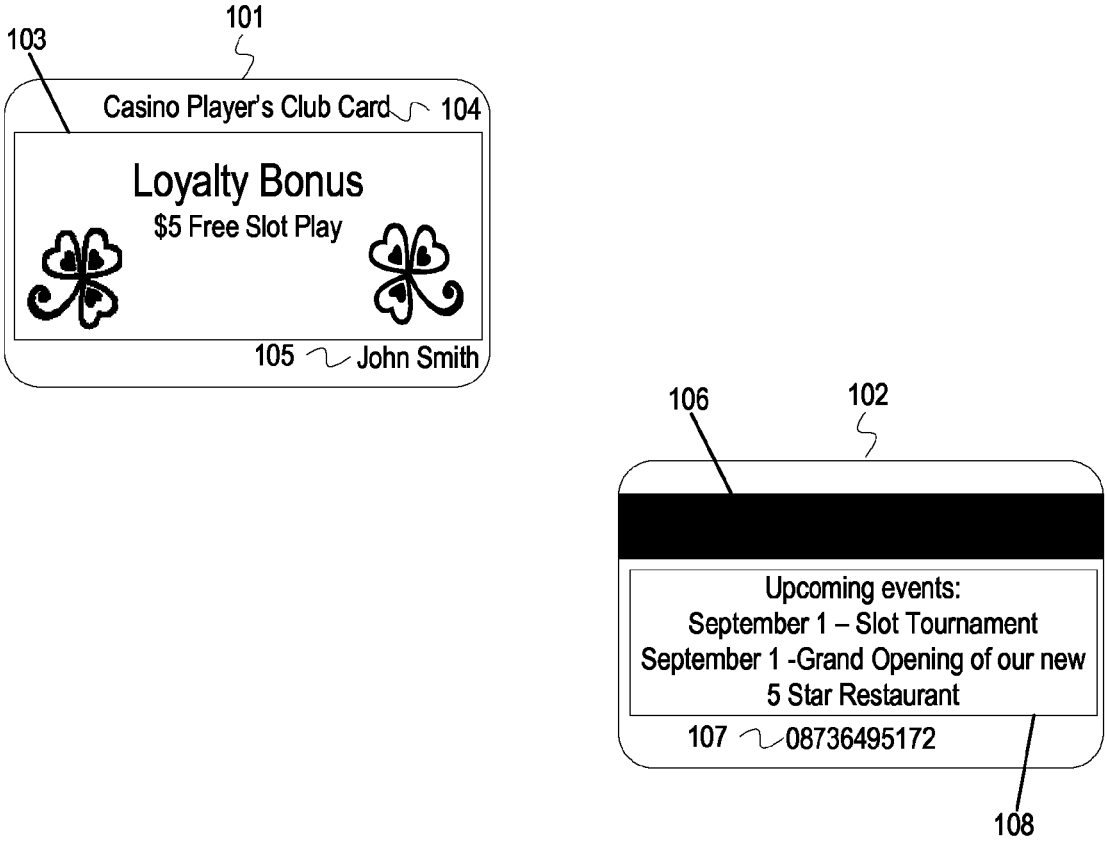
FIG. 1 is an example conceptual diagram of a player tracking card with electronic paper.

FIG. 1 is an example conceptual diagram of a player tracking card with electronic paper. A player tracking card comprises a front side 101 and a back side 102. The front side 101 comprises an e-paper 103 and two static items, a loyalty club title 104 and a player's name 105. The back side 102 comprises a magnetic strip 106, an e-paper 108, and a loyalty account number 107. The e-paper 103 and 108 can be updated to change the theme and/or appearance of the player tracking card. For example, the theme of the player tracking card is changed at the beginning of winter to reflect a "winter wonderland" theme. As another example, the appearance of the player tracking card may be changed in accordance with a new logo. The e-paper 103 and 108 can display promotional information (e.g., bonuses, coupons, upcoming events, announcements, etc.) and information tailored to the player (e.g., a loyalty club balance, elite status indications, reservation information, event reminders, etc.). In this example, the e-paper 103 displays a loyalty bonus, "$5 in free slot play." The e-paper 108 displays a list of upcoming events. The e-paper 103 and 108 can be used to display images comprising text, graphics, or both. Images written to the e-paper 103 and 108 are persistent so that the images are displayed until overwritten with other images. The e-paper 103 and 108 can display images without utilizing power supplies.

In this example, the loyalty club title 104, the player's name 105, and the loyalty account number 107 represent static areas of the player tracking card. However, e-paper and static areas can be utilized on player tracking cards based on preferences of wagering game establishments. For example, an e-paper can encompass the entire front side of a player tracking card allowing cards to be re-used even between different players.

The magnetic strip 106 is used by a WGM to identify the player and access the player's profile. The player's profile can include player demographics, earned loyalty rewards, an elite status, etc. The player's profile may also be linked to a wagering account. The WGM can access a balance in the wagering account to enable play and increase the loyalty rewards during play. The loyalty account number 107 can be used to identify the player if the magnetic strip 106 is not readable. In addition, a WGM can utilize optical character recognition techniques to recognize player/account identification data on either of the e-paper 103, 108.

The player tracking card comprises a support structure. The support structure can be made from a variety of materials including plastic, bamboo, plexiglass, etc. The support structure can be semi-rigid so that the player tracking card is somewhat flexible. The support structure can also be rigid so the player tracking card is not flexible. The e-paper 103, the e-paper 108, and the magnetic strip 106 can be affixed to the support structure, embedded in the support structure, or a combination thereof.

Figure 2:
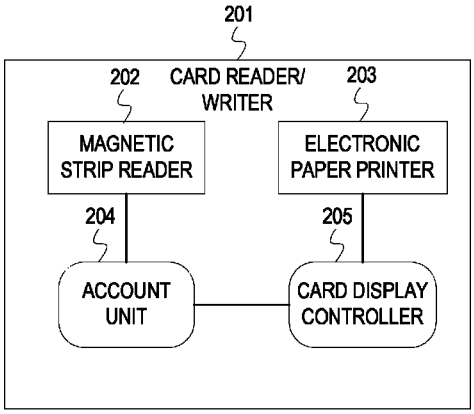
FIG. 2 is an example conceptual diagram of a card reader/writer.

FIG. 2 is an example conceptual diagram of a card reader/writer. A card reader/writer 201 comprises a magnetic strip reader 202, an account unit 204, an electronic paper printer 203, and a card display controller 205.

The magnetic strip reader 202 can read data encoded on a magnetic strip of a player tracking card inserted into the card reader/writer 201. The magnetic strip can encode a player identifier associated with a loyalty account and/or a wagering account. The account unit 204 can allow a player to make wagers from the wagering account. The account unit 204 can determine loyalty rewards to add to the loyalty account based on wagered amounts, time spent playing, elite status of the player, etc. The account unit 204 determines content that should be written to e-paper on the player tracking card. For example, the account unit 204 determines that the player won a free meal in a bonus game, so a coupon for the free meal should be displayed on the player tracking card. The account unit 204 can generate or supply an image that represents the coupon.

The card display controller 205 instructs the electronic paper printer 203 to write content to the e-paper on the player tracking card. Instructing the electronic paper printer 203 to write the content comprises determining instructions for writing images representing the content. For example, the card display controller 205 instructs the electronic paper printer 203 to write the image representing the coupon to an e-paper on the player tracking card. The electronic paper printer 203 can apply voltages to electrodes on the surface of an e-paper, in accordance with instructions from the card display controller, to polarize pigments that constitute pixels on the e-paper.

Figure 3:
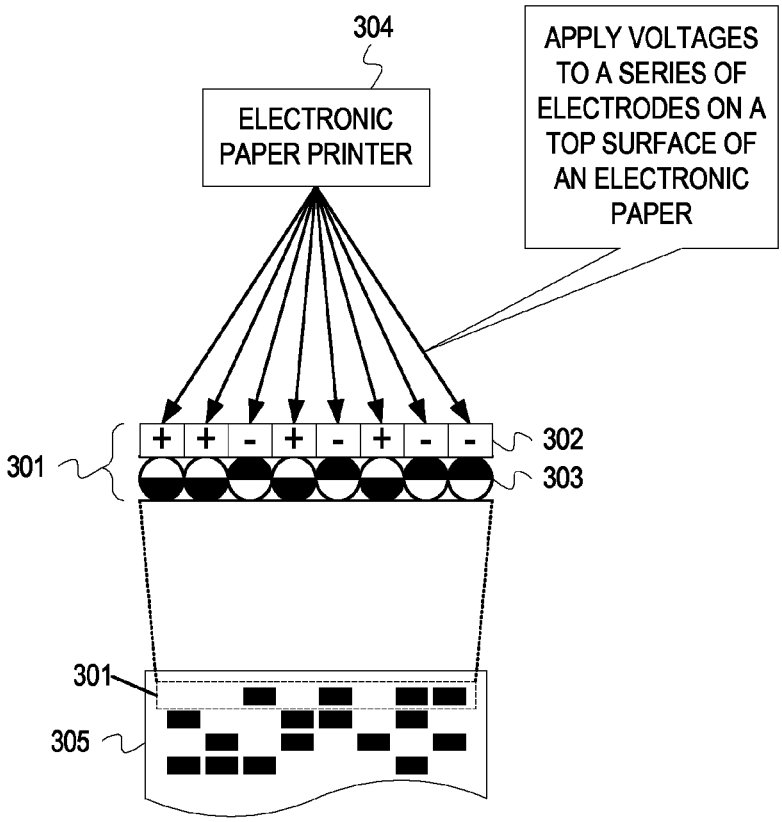
FIG. 3 is a conceptual diagram of an example electronic paper printer writing to an electronic paper.

FIG. 3 is a conceptual diagram of an example electronic paper printer writing to an electronic paper. A cross-section 301 of an e-paper comprises a series of electrodes 302 and series of pixels 303. The cross-section 301 represents a row on an e-paper 305.

The electrodes 302 are on the top surface of the e-paper and are transparent so the pixels 303 are viewable. Each of the electrodes 302 corresponds to one of the pixels 303. In this example, the e-paper displays black and white images. In other examples, the e-paper can display color images.

The pixels 303 can comprise transparent capsules containing black and white pigments. The white pigments can be negatively charged, the black pigments can be positively charged, or both. In some embodiments, the polarities of the white pigments and black pigments may be reversed. An electronic paper printer 304 can apply voltages to the electrodes 302 to polarize the pigments in the pixels 303 so that each of the pixels 303 turns white or black. A positive voltage on one of the electrodes 302 can turn the corresponding one of the pixels 303 white. A negative voltage on one of the electrodes 302 can turn the corresponding one of the pixels 303 black.

Figure 4:
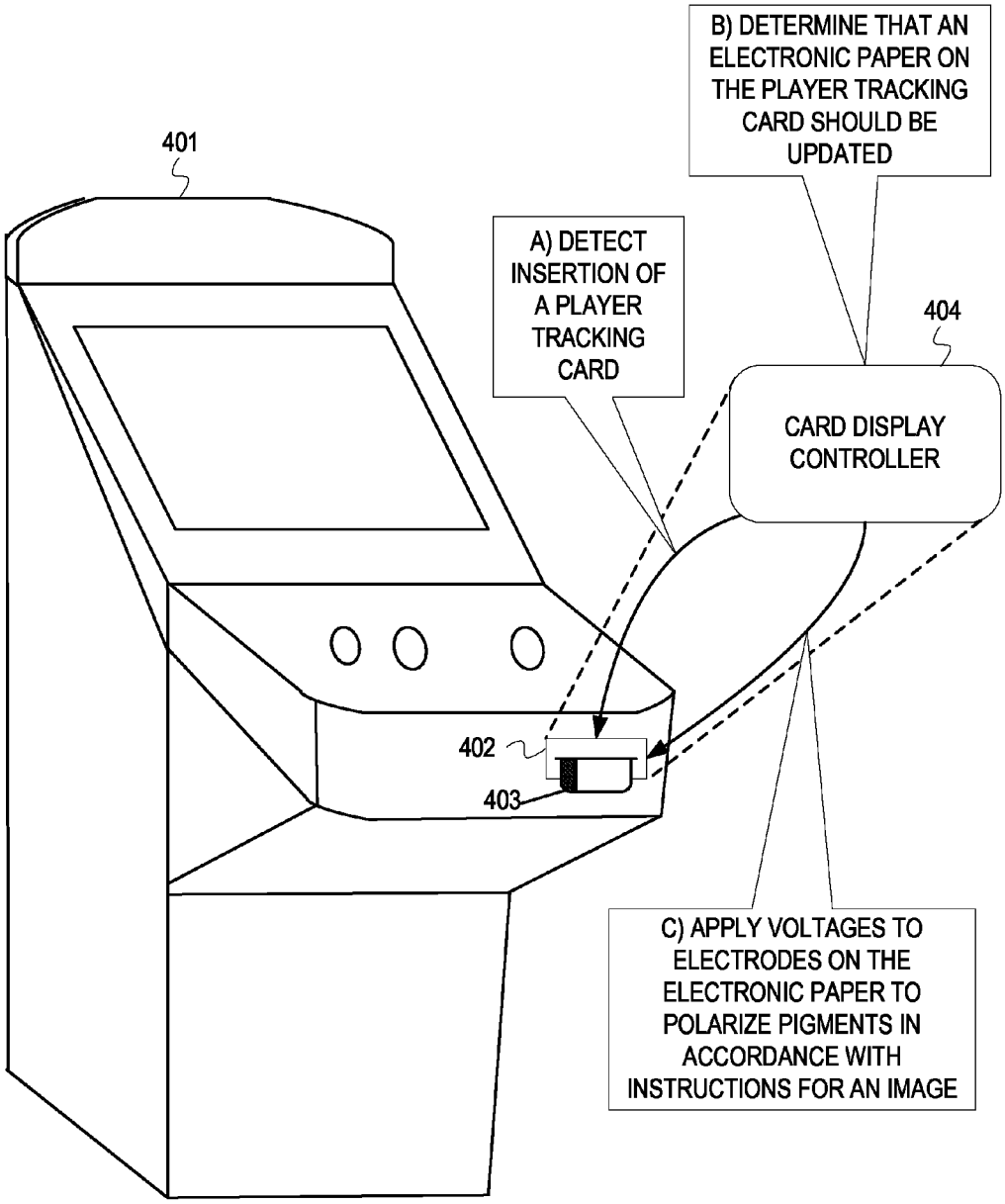
FIG. 4 is a conceptual diagram of an example of utilizing a card reader/writer in a WGM to write content to an e-paper on a player tracking card.

FIG. 4 is a conceptual diagram of an example of utilizing a card reader/writer in a WGM to write content to an e-paper on a player tracking card. A WGM 401 is equipped with a card reader/writer 402. The card reader/writer 402 comprises a card display controller 404, an electronic paper printer, and a magnetic strip reader.

At stage A, the card display controller 404 detects insertion of a player tracking card with an e-paper. For example, the card display controller 404 receives a player identifier from the magnetic strip reader.

At stage B, the card display controller 404 determines that an e-paper on the player tracking card should be updated. For example, the card display controller 404 determines that the player tracking card has not been used in a week, so the card display controller 404 determines that the e-paper should be updated to reflect this week's events. As another example, the card display controller 404 determines that a player has reached a new player status tier for amounts wagered, so the card display controller 404 determines that a trophy should be displayed on the e-paper to indicate the player's elite status.

At stage C, the card display controller 404 utilizes the electronic paper printer to apply voltages to electrodes on the e-paper to polarize the pigments in accordance with instructions for an image. For example, the card display controller 404 transmits a steam of ones and zeros to the electronic paper printer. The ones and zeros represent positive and negative voltages to be applied to electrodes on the e-paper.

Although examples refer to using card readers/writers in WGMs, embodiments are not so limited. For example, a point-of-sale system in a casino restaurant can utilize a card reader/writer with a card display controller. The card reader/writer in the casino restaurant can update the e-paper to remove the image of the free meal coupon so that the coupon is only used once.

Figure 5:
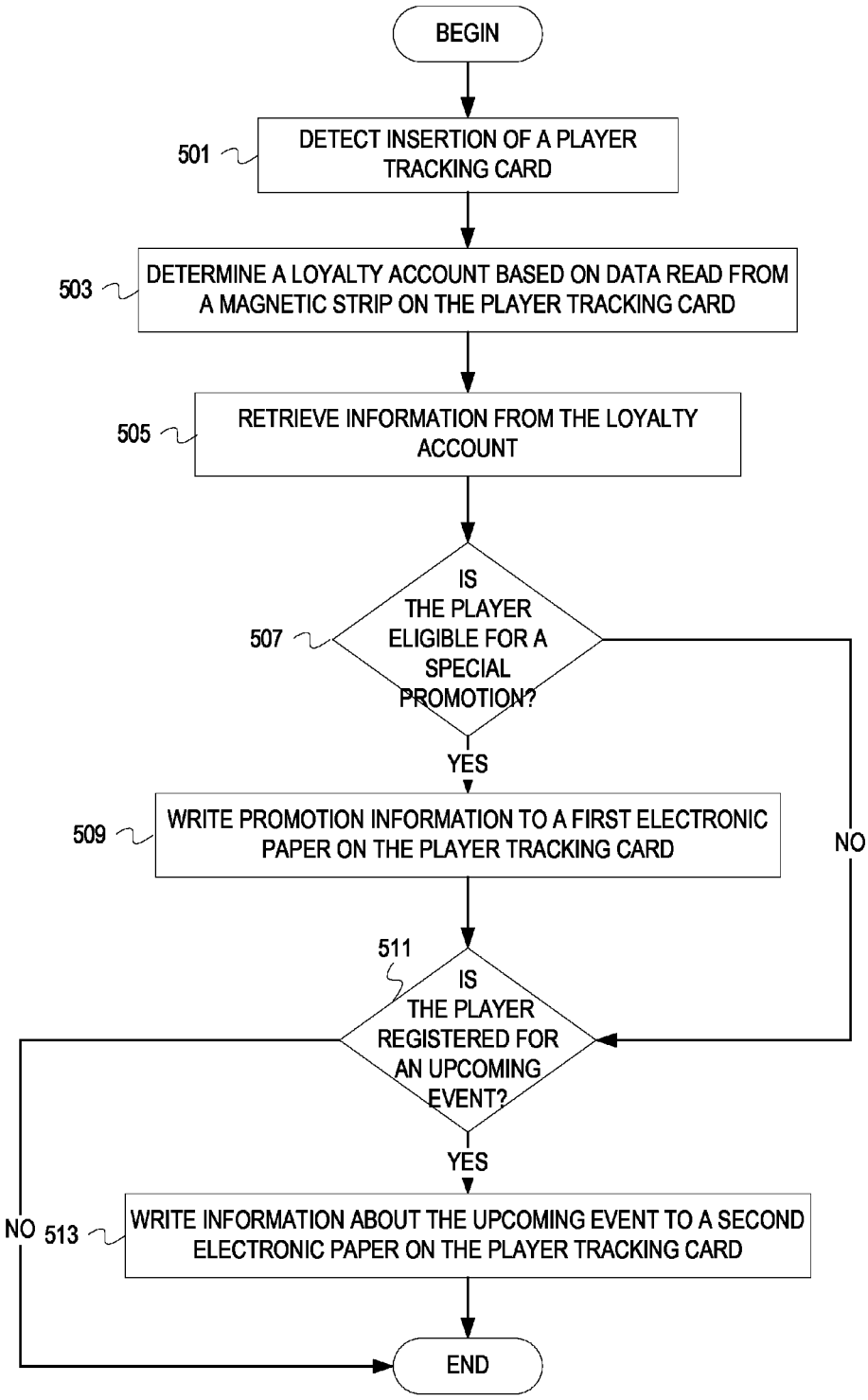
FIG. 5 is a flowchart depicting example operations for writing promotional information to an electronic paper on a player tracking card.

FIG. 5 is a flowchart depicting example operations for writing promotional information to an electronic paper on a player tracking card. Flow beings at block 501, where insertion of a player tracking card is detected.

At block 503, a loyalty account is determined based on data read from a magnetic strip on the player tracking card. Determining the loyalty account can comprise accessing an account database and searching for a record based on an identifier encoded in the data.

At block 505, information from the loyalty account is retrieved. For example, a record is located in an account database based on an identifier encoded in magnetic strip data. Information in the record is retrieved from the database.

At block 507, it is determined if the player is eligible for a special promotion. For example, the player is eligible for free play if the player has wagered more than $200 in the past 24 hours. If the player is eligible for the special promotion, flow continues at block 509. If the player is not eligible for the special promotion, flow continues at block 511.

At block 509, promotion information is written to a first e-paper on the player tracking card. Writing information to the first e-paper can comprise applying voltages to electrodes on the e-paper to polarize the pigments in accordance with instructions for an image.

At block 511, it is determined if the player is registered for an upcoming event. For example, the player may be registered to compete in a slot tournament. As another example, the player may have dinner reservations at a restaurant within a casino. If the player is registered for an upcoming event, flow continues at block 513. If the player is not registered for an upcoming event, flow ends.

At block 513, information about the upcoming event is written to s second e-paper on the player tracking card.

Figure 6:
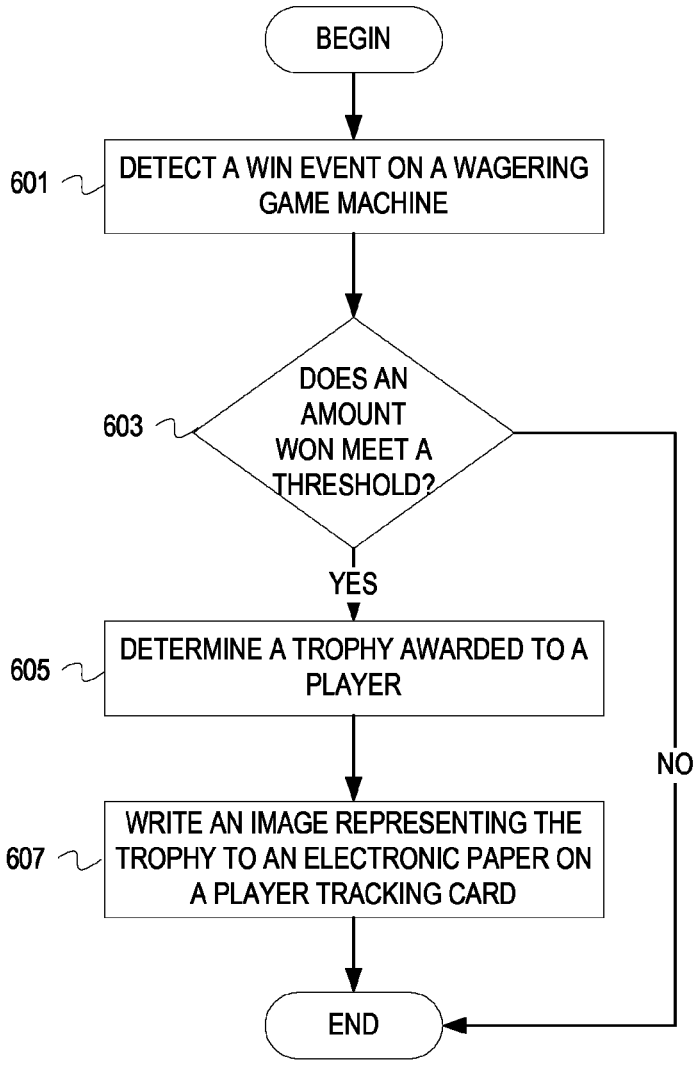
FIG. 6 is a flowchart depicting example operations for writing content to an electronic paper on a player tracking card based on a bonus.

Embodiments are not limited to writing information for promotions and events to e-paper integrated into a player card. Information may be written to player tracking cards based on events in a game (e.g., wins, bonuses, completion of levels, etc.). FIG. 6 is a flowchart depicting example operations for writing content to an electronic paper on a player tracking card based on a bonus. Flow begins at block 601, where a win event is detected on a WGM. For example, a player wins a jackpot.

At block 603, it is determined if an amount won meets a threshold. If the amount won meets the threshold, flow continues at block 605. If the amount won does not meet the threshold, flow ends.

At block 605, a trophy awarded to the player is determined. Different trophies may be awarded to players based on meeting different thresholds.

At block 607, an image representing the trophy is written to an e-paper on the player tracking card.

Although examples refer to using e-paper on player tracking cards, embodiments are not so limited. As another example, hotels can use e-paper on room key cards. When a guest checks in, a hotel clerk can insert a room key card into a card reader/writer to write an appropriate room number on the key card.

Figure 7:
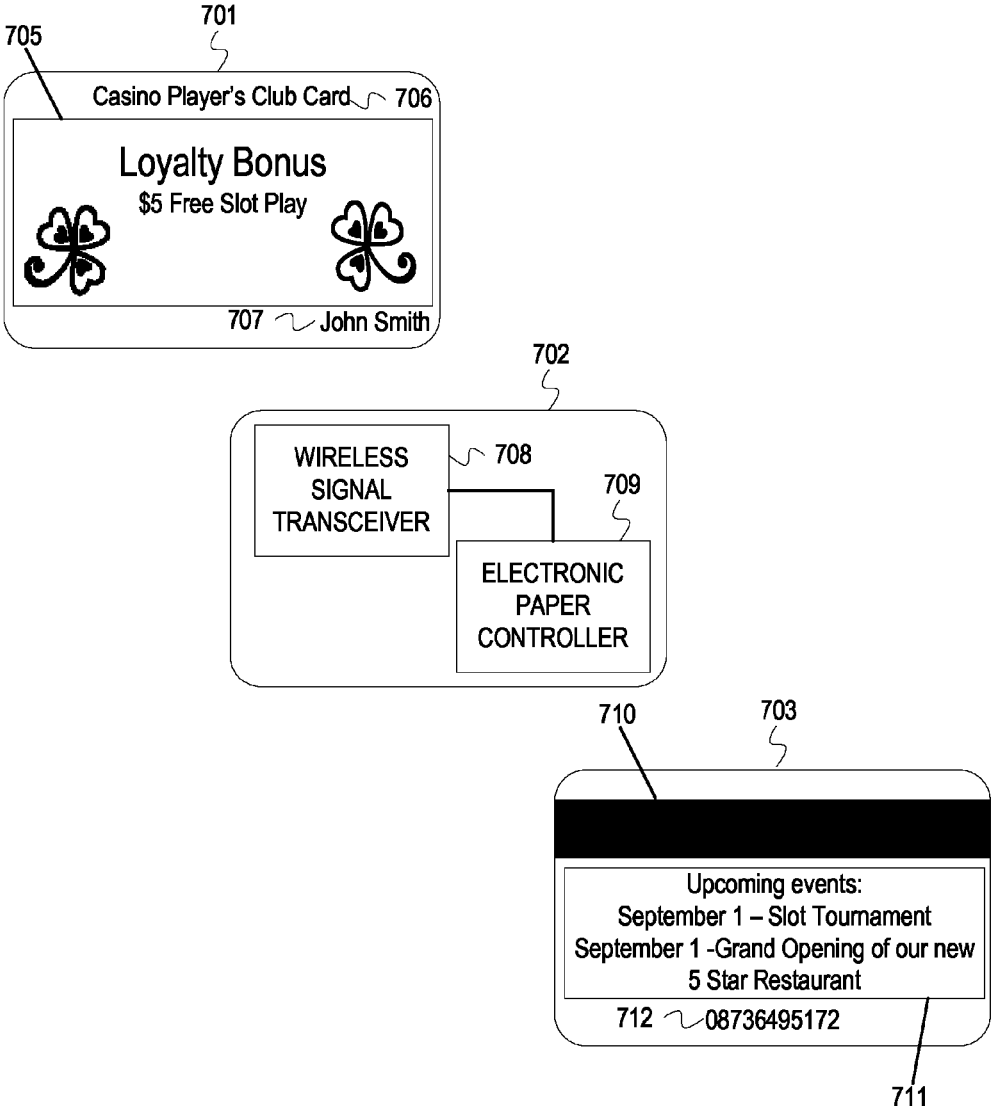
FIG. 7 is an example conceptual diagram of a player tracking card with electronic paper and an interface for writing to the electronic paper.

Although the examples thus far have referred to a card reader/writer, embodiments are not so limited. Embodiments can implement a card with additional functionality. Embodiments can include an interface for writing to e-paper in a player tracking card. A wireless signal can be transmitted to the player tracking card. The wireless signal can power an electronic paper controller and can contain instructions for writing an image on the e-paper. FIG. 7 is an example conceptual diagram of a player tracking card with electronic paper and an interface for writing to the electronic paper. A player tracking card comprises a front side 701, an interface 702, and a back side 703. The front side 701 comprises an e-paper 705 and two static items, a loyalty club title 706 and a player's name 707. The back side 703 comprises a magnetic strip 710, an e-paper 711, and a loyalty account number 712. The e-paper 705 and 711 can display promotional information (e.g., bonuses, coupons, upcoming events, announcements, etc.) and information tailored to the player (e.g., a loyalty club balance, elite status indications, reservation information, event reminders, etc.). In this example, the e-paper 705 displays a loyalty bonus, "$5 in free slot play." The e-paper 711 displays a list of upcoming events. The e-paper 705 and 711 can be used to display images comprising text, graphics or both. Images written to the e-paper 705 and 711 are persistent so that the images are displayed until overwritten with other images. The e-paper 705 and 711 can display images without utilizing power supplies.

In this example, the loyalty club title 706, the player's name 707, and the loyalty account number 712 represent static areas of the player tracking card. However, e-paper and static areas can be utilized on player tracking cards based on preferences of wagering game establishments. For example, an e-paper can encompass the entire front side of a player tracking card. The magnetic strip 710 is used by a WGM to identify the player and access the player's profile.

The interface 702 comprises a wireless signal transceiver 708 and an electronic paper controller 709. The interface 702 can be powered by a wireless signal (e.g., radio-frequency identification (RFID), Institute of Electrical and Electronics Engineers' (IEEE) 802.11 (Wi-Fi), etc.). The wireless signal transceiver can transmit a player identifier to a checkpoint. In response, the checkpoint retrieves account information based on the player identifier and determines content that should be displayed on the e-paper 705 and 711. The checkpoint transmits wireless signals containing data representing the content to the wireless signal receiver. For example, the wireless signal transceiver 708 can receive wireless signals containing instructions for writing the e-paper 705 and 711. The wireless signal transceiver 708 candecode the wireless signals to determine the instructions, and pass the instructions to the electronic paper controller 709. As another example, the wireless signal transceiver 708 can receive wireless signals containing image files representing the content to be displayed on the e-paper 705 and 711. The wireless signal transceiver 708 passes the data to the electronic paper controller 709.

The electronic paper controller 709 writes the content to the e-paper 705 and 711 based on the data received by the wireless signal receiver 708. For example, the electronic paper controller 709 applies voltages to electrodes in the e-paper 705 and 711 to polarize pigments according to instructions for the images. As another example, the electronic paper controller 709 can determine polarities of the pixels based on an image file and can apply voltages to the electrodes to polarize the pigments accordingly.

Figure 8:
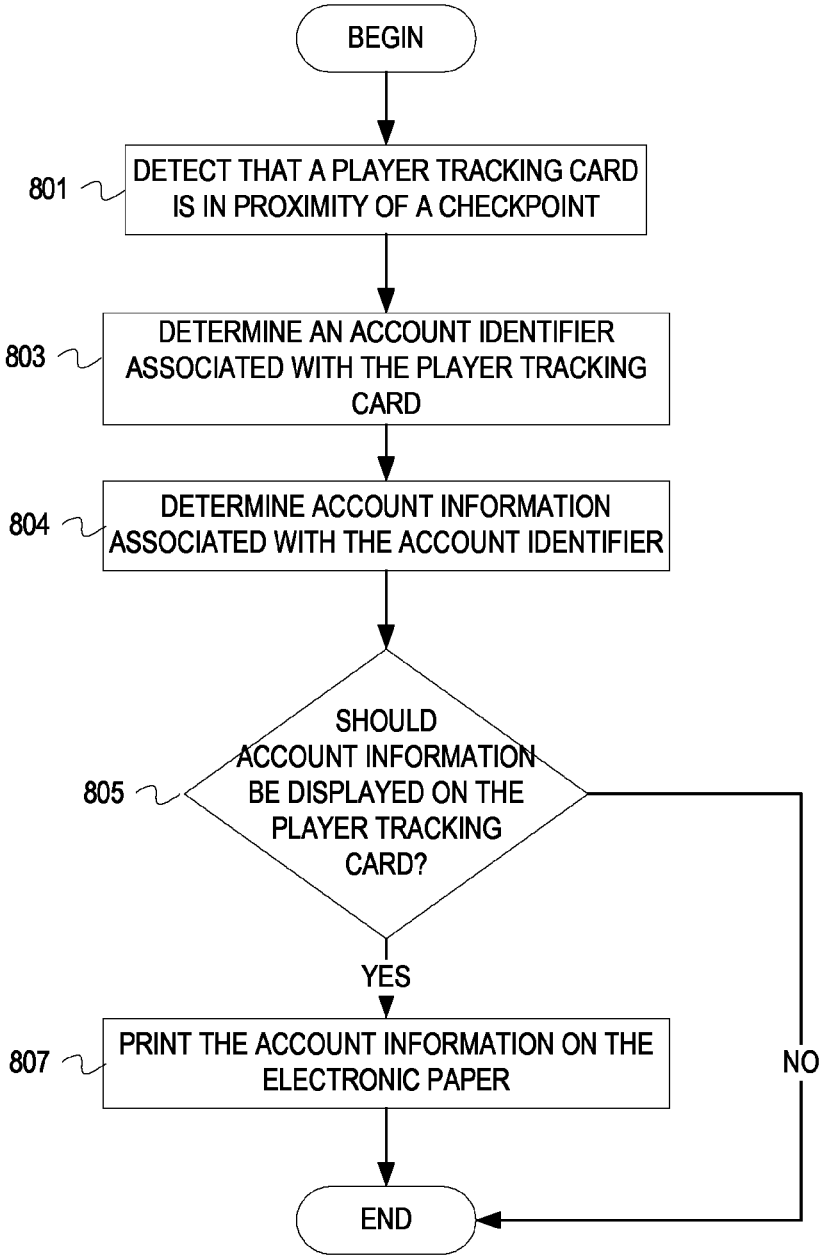
FIG. 8 is a flowchart of example operations for writing content to an electronic paper on a player tracking card using wireless signals.

FIG. 8 is a flowchart of example operations for writing content to an electronic paper on a player tracking card using wireless signals. Flow begins at block 801, where it is detected that player tracking card is in proximity of a checkpoint. For example, an RFID transceiver on the player tracking card is powered on by an RFID signal transmitted by the checkpoint causing the player tracking card to transmit a message. The checkpoint receives the message.

At block 803, an account identifier of the player's club card is determined. For example, the checkpoint determines the account identifier from a message transmitted by the player tracking card.

At block 804, account information associated with the account identifier is determined. For example, a checkpoint requests account information associated with the account identifier. The checkpoint can transmit a request containing the account identifier to a loyalty account system. In response, the loyalty account system transmits the account information to the checkpoint.

At block 805, it is determined if the account information should be displayed on the player tracking card. Examples of account information include a wagering account balance, a loyalty rewards balance, win/loss summaries, etc. The account information may be considered confidential, so account preferences can indicate whether a player wishes for the account information to be displayed. The account preferences may also indicate an amount of time that the account information should be displayed. For example, the checkpoint determines that a loyalty balance should be displayed for no more than 3 seconds. If the account information should be displayed, flow continues at block 807. If the account information should not be displayed, flow ends.

At block 807, the account information is printed to the electronic paper on the player tracking card for display. For example, a player tracking card receives account information, and an electronic paper printer/controller writes the account information to the e-paper.

A power supply (i.e., a battery) can be included in a player tracking card to preserve security of the account information. For example, an electronic paper controller writes an account balance to the e-paper. After a certain amount of time has elapsed, the electronic paper controller can overwrite the e-paper so that the account balance disappears. Because the player tracking card is self-powered, the electronic paper can overwrite the account balance controller even if the player tracking card is no longer in proximity to the checkpoint.

Wagering Game Machine Architectures

Figure 9:
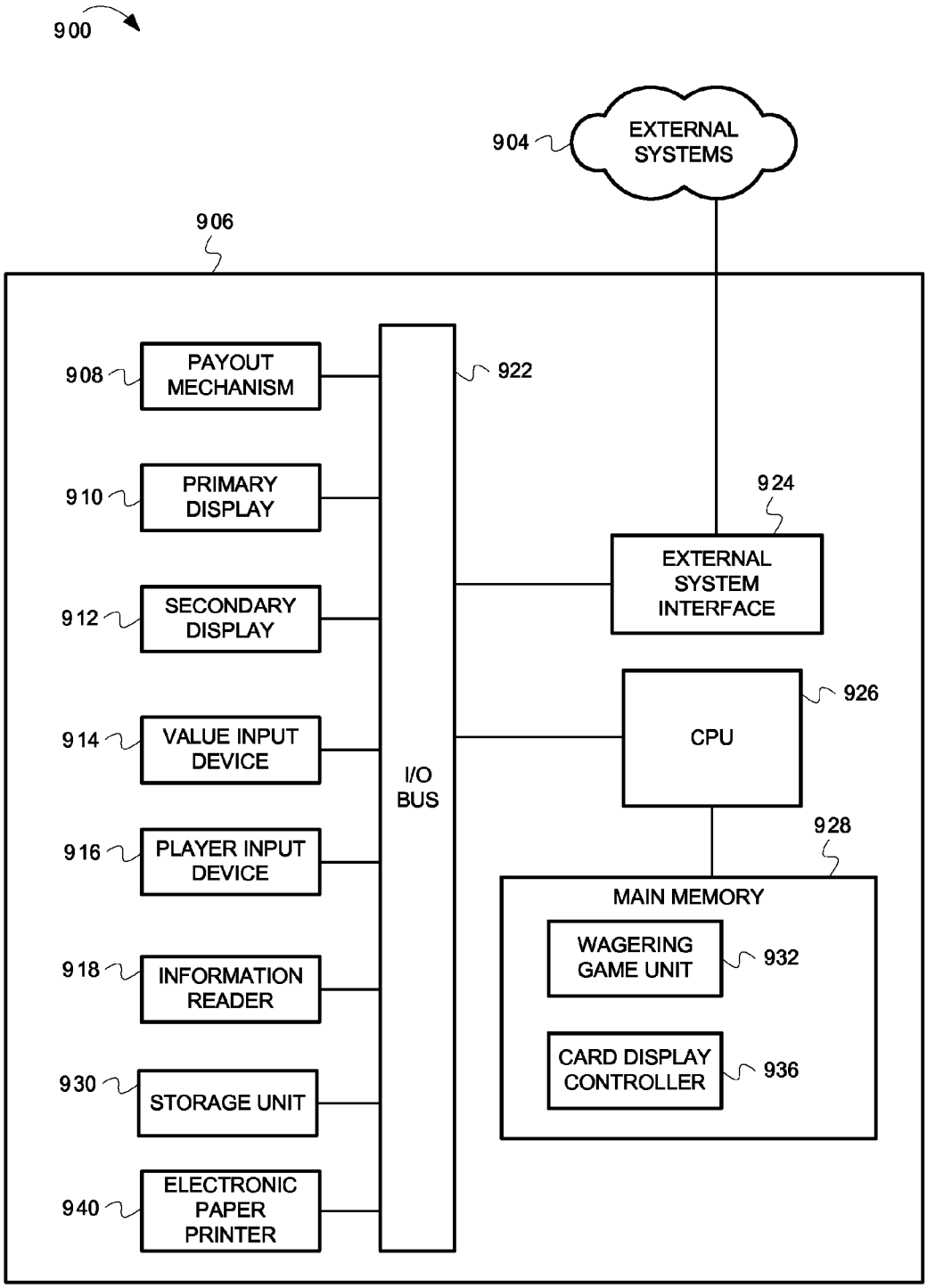
FIG. 9 is a block diagram illustrating a wagering game machine architecture, according to example embodiments of the invention.

FIG. 9 is a block diagram illustrating a wagering game machine architecture, according to example embodiments of the invention. As shown in FIG. 9, the wagering game machine architecture 900 includes a wagering game machine 906, which includes a central processing unit (CPU) 926 connected to main memory 928. The CPU 926 can include any suitable processor, such as an Intel® Pentium processor, Intel® Core 2 Duo processor, AMD®, Opteron™ processor, or UltraSPARC processor. The main memory 928 includes a wagering game unit 932. In one embodiment, the wagering game unit 932 can present wagering games, such as video poker, video black jack, video slots, video lottery, etc., in whole or part. The main memory 928 also includes a card display controller 936. The card display controller 936 determines content to be displayed on an e-paper display of a player tracking card. The card display controller 936 instructs an electronic paper printer 940 to write the content to the e-paper.

The CPU 926 is also connected to an input/output (I/O) bus 922, which can include any suitable bus technologies, such as an AGTL+ frontside bus and a PCI backside bus. The I/O bus 922 is connected to a payout mechanism 908, primary display 910, secondary display 912, value input device 914, player input device 916, information reader 918, storage unit 930, and an electronic paper printer 940. The player input device 916 can include the value input device 914 to the extent the player input device 916 is used to place wagers. The I/O bus 922 is also connected to an external system interface 924, which is connected to external systems 904 (e.g., wagering game networks). The electronic paper printer 940 applies voltages to electrodes on an e-paper in accordance with instructions, received from the card display controller, for an image.

In one embodiment, the wagering game machine 906 can include additional peripheral devices and/or more than one of each component shown in FIG. 9. For example, in one embodiment, the wagering game machine 906 can include multiple external system interfaces 924 and/or multiple CPUs 926. In one embodiment, any of the components can be integrated or subdivided.

Any component of the architecture 900 can include hardware, firmware, and/or machine-readable media including instructions for performing the operations described herein. Machine-readable media includes any mechanism that provides (i.e., stores and/or transmits) information in a form readable by a machine (e.g., a wagering game machine, computer, etc.). For example, tangible machine-readable media includes read only memory (ROM), random access memory (RAM), magnetic disk storage media, optical storage media, flash memory machines, etc. Machine-readable media also includes any media suitable for transmitting software over a network.

While FIG. 9 describes an example wagering game machine architecture, this section continues with a discussion wagering game networks.

Wagering Game Networks

Figure 10:
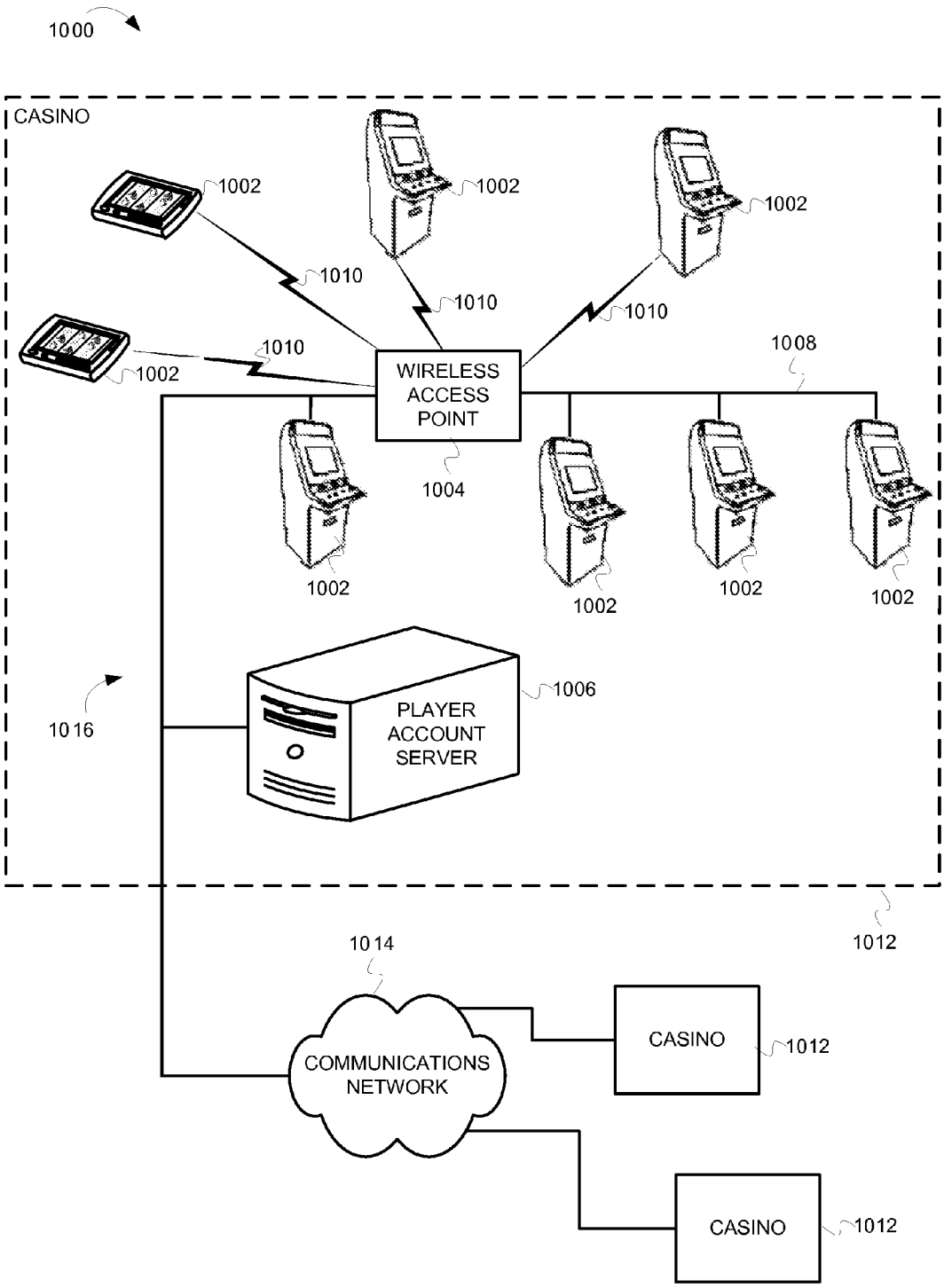
FIG. 10 is a block diagram illustrating a wagering game network 1000, according to example embodiments of the invention.

FIG. 10 is a block diagram illustrating a wagering game network 1000, according to example embodiments of the invention. As shown in FIG. 10, the wagering game network 1000 includes a plurality of casinos 1012 connected to a communications network 1014.

Each casino 1012 includes a local area network 1016, which includes an access point 1004, a wagering game server 1006, and wagering game machines 1002. The access point 1004 provides wireless communication links 1010 and wired communication links 1008. The wired and wireless communication links can employ any suitable connection technology, such as Bluetooth, 802.11, Ethernet, public switched telephone networks, SONET, etc. In some embodiments, the wagering game server 1006 can serve wagering games and distribute content to devices located in other casinos 1012 or at other locations on the communications network 1014.

The wagering game machines 1002 described herein can take any suitable form, such as floor standing models, hand-held mobile units, bartop models, workstation-type console models, etc. Further, the wagering game machines 1002 can be primarily dedicated for use in conducting wagering games, or can include non-dedicated devices, such as mobile phones, personal digital assistants, personal computers, etc. In one embodiment, the wagering game network 1000 can include other network devices, such as accounting servers, wide area progressive servers, player tracking servers, and/or other devices suitable for use in connection with embodiments of the invention.

In some embodiments, wagering game machines 1002 and wagering game servers 1006 work together such that a wagering game machine 1002 can be operated as a thin, thick, or intermediate client. For example, one or more elements of game play may be controlled by the wagering game machine 1002 (client) or the wagering game server 1006 (server). Game play elements can include executable game code, lookup tables, configuration files, game outcome, audio or visual representations of the game, game assets or the like. In a thin-client example, the wagering game server 1006 can perform functions such as determining game outcome or managing assets, while the wagering game machine 1002 can present a graphical representation of such outcome or asset modification to the user (e.g., player). In a thick-client example, the wagering game machines 1002 can determine game outcomes and communicate the outcomes to the wagering game server 1006 for recording or managing a player's account.

In some embodiments, either the wagering game machines 1002 (client) or the wagering game server 1006 can provide functionality that is not directly related to game play. For example, account transactions and account rules may be managed centrally (e.g., by the wagering game server 1006) or locally (e.g., by the wagering game machine 1002). Other functionality not directly related to game play may include power management, presentation of advertising, software or firmware updates, system quality or security checks, etc. The wagering game server 1006, serve player account information to the wagering game machines 1002. The wagering game server 1006 can also determine, based on player account information, content to be displayed on a player tracking card's e-paper display and transmit data representing the content.

Any of the wagering game network components (e.g., the wagering game machines 1002) can include hardware and machine-readable media including instructions for performing the operations described herein.

General

This detailed description refers to specific examples in the drawings and illustrations. These examples are described in sufficient detail to enable those skilled in the art to practice the inventive subject matter. These examples also serve to illustrate how the inventive subject matter can be applied to various purposes or embodiments. Other embodiments are included within the inventive subject matter, as logical, mechanical, electrical, and other changes can be made to the example embodiments described herein. Features of various embodiments described herein, however essential to the example embodiments in which they are incorporated, do not limit the inventive subject matter as a whole, and any reference to the invention, its elements, operation, and application are not limiting as a whole, but serve only to define these example embodiments. This detailed description does not, therefore, limit embodiments of the invention, which are defined only by the appended claims. Each of the embodiments described herein are contemplated as falling within the inventive subject matter, which is set forth in the following claims.

The invention claimed is:

1. A method comprising:

supplying an identifier of a player account from a rewritable display card, wherein the rewriteable display card comprises an electronic paper and a power supply;

receiving instructions to display content based, at least in part, on the player account associated with the identifier, wherein the content comprises player account information and at least one of an indication that the player account is eligible for a promotion, an indication of an upcoming event, and a trophy associated with a wagering game event;

writing the content to the electronic paper;

determining that at least a first part of the player account information has a time limit for display; and updating the electronic paper to remove the at least first part of the player account information from display after the time limit expires.

2. The method of claim 1, wherein the content comprises one or more of text and an image.

3. The method of claim 1, wherein said determining the content to be displayed on the electronic paper based, at least in part, on the account information comprises determining that a user associated with the rewritable display card is eligible for a promotion.

4. The method of claim 1, wherein said determining the content to be displayed on the electronic paper based, at least in part, on the account information comprises determining that a user associated with the rewritable display card is registered for a future event.

5. The method of claim 1, wherein the wagering game event comprises a win of an amount that exceeds a threshold for awarding the trophy.

6. The method of claim 1, further comprising wirelessly transmitting data representing the content to an electronic paper controller on the rewriteable display card, wherein the electronic paper controller performs said writing responsive to said wirelessly transmitting the data representing the content.

7. One or more non-transitory machine-readable media having instructions stored therein, which, when executed by a set of one or more processors, causes the set of one or more processors to perform operations that comprise:

supplying an identifier of a player account from a rewritable display card, wherein the rewriteable display card comprises an electronic paper and a power supply;

receiving instructions to display content based, at least in part, on the player account associated with the identifier, wherein the content comprises player account information and at least one of an indication that the player account is eligible for a promotion, an indication of an upcoming event, and a trophy associated with a wagering game event;

writing the content to the electronic paper;

determining that at least a first part of the player account information has a time limit for display; and updating the electronic paper to remove the at least first part of the player account information from display after the time limit expires.

8. The machine-readable media of claim 7, wherein the content comprises one or more of text and an image.

9. The machine-readable media of claim 7, wherein said operation of determining the content to be displayed on the electronic paper based, at least in part, on the account information comprises determining that a user associated with the rewritable display card is eligible for a promotion.

10. The machine-readable media of claim 7, wherein said operation of determining the content to be displayed on the electronic paper based, at least in part, on the account information comprises determining that a user associated with the rewritable display card is registered for a future event.

11. The machine-readable media of claim 7, wherein the wagering game event comprises a win of an amount that exceeds a threshold for awarding the trophy.

12. The machine-readable media of claim 7, wherein the operations further comprise wirelessly transmitting data representing the content to an electronic paper controller on the rewriteable display card to cause the electronic paper controller to perform said writing the content to the electronic paper responsive to said wirelessly transmitting the data representing the content.

13. An apparatus comprising:

an electronic paper;

means for determining content to display on the electronic paper based, at least in part, on player account information associated with the apparatus;

means for writing the content to the electronic paper; and means for updating the electronic paper to remove at least a portion of the content after expiration of a time period, wherein a player preference associated with the player account information specifies the time period for the at least the portion of the content.

14. The apparatus of claim 13, wherein the content comprises at least one of text and an image.

* * * * *